US005692278A

United States Patent [19]

Fleissner

[11] Patent Number: 5,692,278

[45] Date of Patent: Dec. 2, 1997

[54] JET BAR ON A DEVICE FOR GENERATING STREAMS OF LIQUID

[75] Inventor: Gerold Fleissner, Zug, Switzerland

[73] Assignee: Fleissner GmbH & Co. Maschinenfabrik, Egelsbach, Germany

[21] Appl. No.: 590,324

[22] Filed: Jan. 23, 1996

[30] Foreign Application Priority Data

Jan. 23, 1995 [DE] Germany ..... 195 01 738.2
Jan. 23, 1995 [DE] Germany ..... 195 01 739.0

[51] Int. Cl.[6] ..... D04H 1/44

[52] U.S. Cl. ..... 28/105; 239/553.5; 239/590.5

[58] Field of Search ..... 239/590.5, 553.5; 28/105, 104

[56] References Cited

U.S. PATENT DOCUMENTS

| | | | |
|---|---|---|---|
| 3,403,862 | 10/1968 | Dworjanyn . | |
| 4,069,563 | 1/1978 | Contactor et al. | 28/105 |
| 4,880,168 | 11/1989 | Randall, Jr. et al. | 239/553.5 |
| 5,042,722 | 8/1991 | Randall, Jr. et al. | 28/105 |

FOREIGN PATENT DOCUMENTS

| | | |
|---|---|---|
| 220 060 | 3/1985 | German Dem. Rep. . |

*Primary Examiner*—Andy Falik
*Attorney, Agent, or Firm*—Antonelli, Terry, Stout & Kraus, LLP.

[57] ABSTRACT

A jet bar on a device for producing streams of liquid for jet interweaving of the fibers of a fiber web guided along the bar includes an upper part that extends over the operating width of the fiber web and a lower part fastened thereto in a liquid-tight manner. In the upper part and extending over its length, a pressure chamber is located which receives liquid that is under pressure, endwise for example. Parallel thereto, with an intermediate partition, a pressure distribution chamber is provided which is connected with the pressure chamber by throughflow holes for liquid extending through the intermediate partition. A jet sheet with holes for forming jets of liquid is mounted in a liquid-tight fashion on the lower part. In order to achieve a better equalization of the pressurized fluid entering the pressure distribution chamber, the pressure distribution chamber terminates in an area opposite the liquid throughflow holes in a slot that is narrow by comparison with the cross section of the pressure distribution chamber, said slot terminating close to or in proximity to holes in the jet sheet. The jet sheet is mounted in a liquid-tight fashion by means of a sealing O-ring. This O-ring can be replaced without disassembling the lower part from the upper part.

17 Claims, 4 Drawing Sheets

JET BAR ON A DEVICE FOR GENERATING STREAMS OF LIQUID

FIELD OF THE INVENTION

This invention relates to a jet bar on a device for producing streams of liquid for jet interlacing of fibers of a fiber web guided along the bar, said bar having an upper part extending over the working width of the fiber web and a lower part fastened thereto in a liquid-tight manner, with a pressure chamber being located in the upper part and over its length, to which chamber the liquid is supplied under pressure, endwise for example, and with a pressure distribution chamber being provided parallel thereto beyond an intermediate partition, said distribution chamber being connected with the pressure chamber by throughflow holes for the liquid being provided in the intermediate partition, and with a jet sheet, with holes for creating jets of the liquid being mounted on the lower part in a liquid-tight manner.

A device of this type is known from U.S. Pat. No. 4,069,563 and DD-A-220 060. This bar has the advantage over DE-C-37 27 843 of a simpler design and, therefore, anticipated shorter downtimes for maintenance. In the device according to the species, the jet sheet is the only thing which must be replaced from time to time for cleaning, which is possible endwise of the jet sheet by means of insert slots that can be opened and closed easily.

SUMMARY OF THE INVENTION

While maintaining the simple and, therefore, economical design of the jet bar defined at the outset, the goal of the invention is to simplify the design, especially to vorticize beforehand to a greater degree the streams of liquid that strike the jet sheet from the partition, in order to permit a more uniform impact of water pressure on the jet sheet and to provide a possibility for replacing the O-ring that seals off the lower part of the jet sheet without disassembling the lower part from the upper part.

To achieve this goal, the invention initially provides that the pressure distribution chamber terminates, in an area opposite the through holes for the liquid, in a slot that is narrow by comparison With the cross section of the pressure distribution chamber, said slot terminating at the holes in the jet sheet. Surprisingly, it has been found that the space in the pressure distribution chamber which increases and then decreases again causes a vorticization of the streams of liquid entering from the throughflow holes. The only important feature is the complete opening of the pressure distribution chamber to the jet sheet, which is effected by the adjoining slot that is open to the jet sheet.

Even better vorticization of the streams of liquid in the pressure distribution chamber is achieved if the streams of liquid emerging from the throughflow holes strike an obstacle in the pressure distribution chamber. This obstacle, however, must not be a able to be clogged. For this reason, the invention provides an impenetrable impact body which must be located over the length of the slot in front of the through holes for the liquid to flow through. The impact body should be capable of allowing the flow to go around its entire cross section.

It has been found to be especially advantageous if the impact body, at a distance from the intermediate partition, is fastened to the latter in multiple fashion over its length, for example by screwing. The type of impact body and the cross section may be different. For example, a circular rod or a sheet can be used that extends transversely with respect to the arrangement of the through holes for the liquid to flow through.

In the flow direction adjacent to the pressure distribution chamber, the liquid passes through the jet sheet provided with the holes. This sheet must be easily replaceable if necessary because of clogging or because of a different design. It is known that the jet sheet can be mounted in the lower part by means of a sealing O-ring in a liquid-tight manner. A provision is made in the design of the device according to the invention such that a repair groove is provided over the entire length and width of the O-groove for the O-ring of the lower part, said groove being located opposite in the upper part of the jet bar, and corresponding heightwise to slightly more than the thickness of the O-ring.

Now in simple fashion, after removal of the lid that covers the insertion slot for the jet sheet, a lengthwise sheet of suitable dimensions can be inserted into this repair groove, said sheet having on the underside facing the O-ring, an O-ring-tensioning device or means whose dimensions are made exactly the same as or slightly larger than the O-groove of the lower part.

When the tensioning device is holding a replacement O-ring under tension, which can be inserted into the annular groove freed by the defective O-ring after the lengthwise sheet is slid into the repair groove, replacement not only of the jet sheet but also of the sealing O-ring is possible at any time without great expense.

BRIEF DESCRIPTION OF THE DRAWINGS

The accompanying drawings show, as an example, a jet bar according to the invention. Additional inventive features will be described with reference to these drawings wherein.

DETAILED DESCRIPTION OF THE INVENTION

Figure 1:
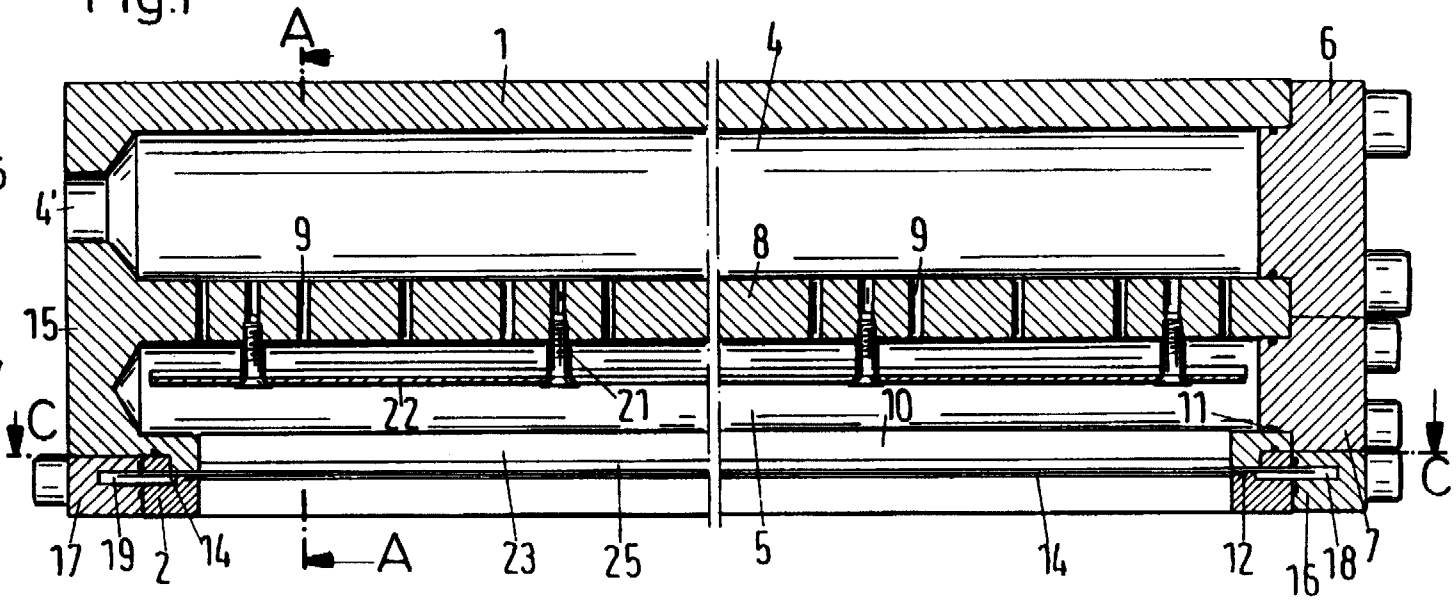
FIG. 1 is a longitudinal section through a jet bar.
Figure 2:
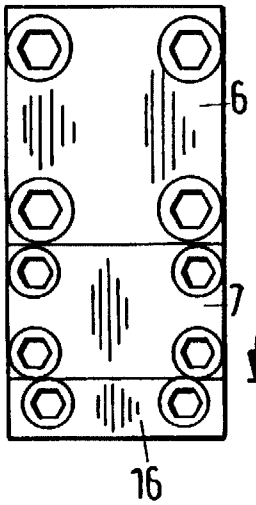
FIG. 2 is an end view of the jet bar according to FIG. 1.
Figure 3:
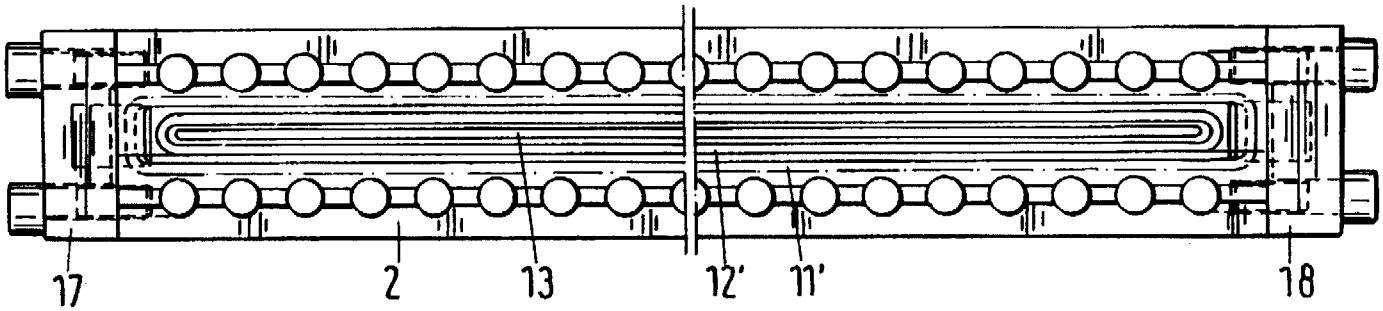
FIG. 3 is a cross-section taken along line C—C in FIG. 1 showing the lower part of the jet bar.

As shown in FIG. 1, the housing of the jet bar comprises an upper part 1, multi-screwed to the lower part 2 over its length by screws 3 from below (see FIG. 4). The upper part 1 has two bores 4 and 5 running lengthwise of which the upper is the pressure chamber 4 and-the lower is the pressure distribution chamber 5. Both chambers are open at one end of the housing and are sealed at this end in a liquid-tight fashion by lids or covers 6 and 7 which are screwed in place. At the other end, pressure chamber 4 has an opening 4' through which the liquid introduced under pressure is admitted. The two chambers 4 and 5 are separated from one another by an intermediate partition 8. Over the length of the jet bar a large number of throughflow holes 9 are arranged in the intermediate partition 8. The holes connect the two chambers so that the liquid flowing into pressure chamber 4 emerges uniformly distributed over its length into pressure distribution chamber 5. The pressure distribution chamber is open at the bottom, namely by means of slot 10 which is narrow by comparison with the diameter of the bore forming pressure distribution chamber 5, said slot likewise extending over the length of the jet bar.

Figure 4:
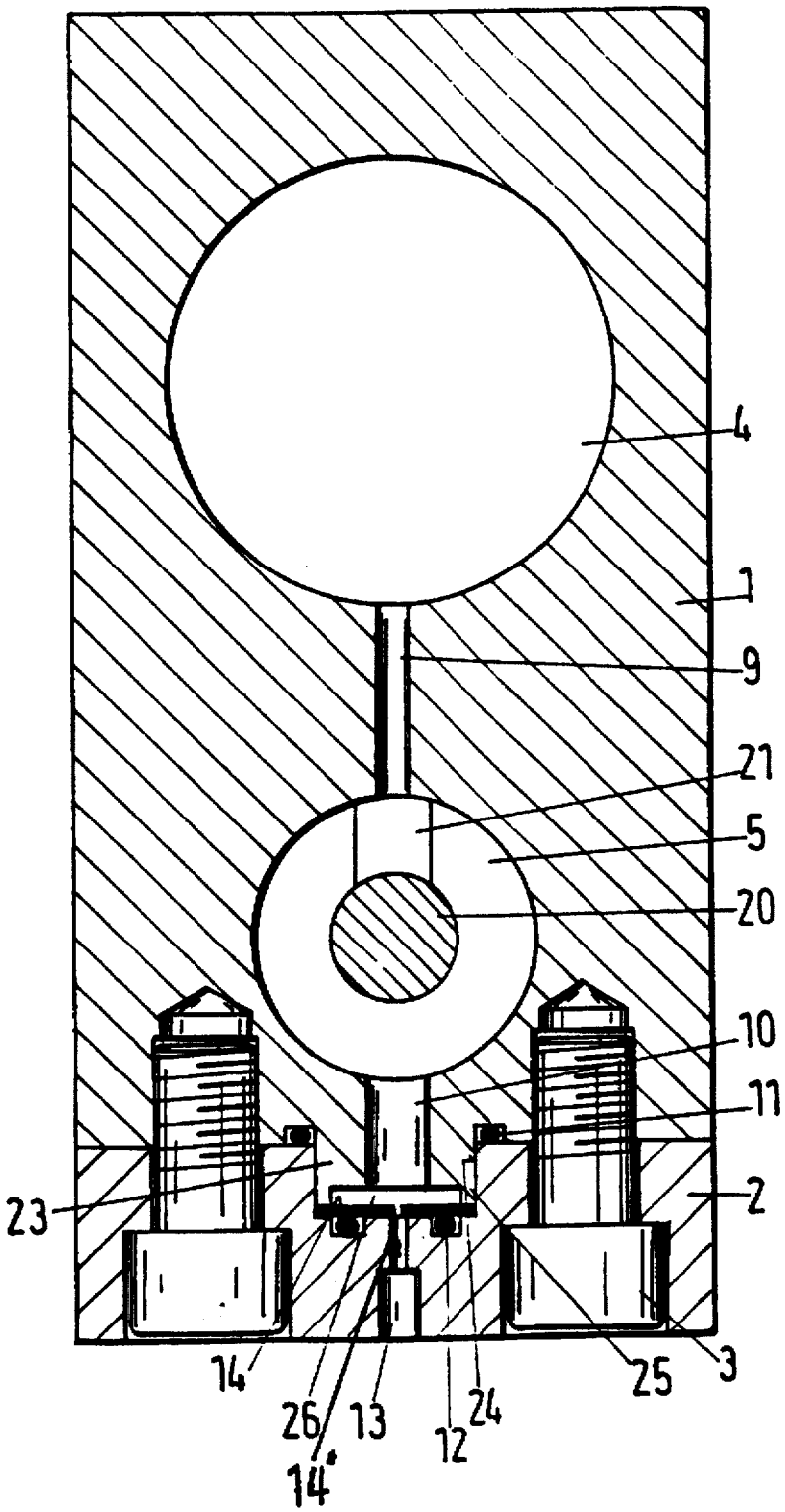
FIG. 4 is a section made transversely through the jet bar according to FIG. 1 along line A—A.

According to FIG. 4, upper part 1 is fastened to lower part 2 firmly and in a liquid-tight fashion. Tightness is effected by an O-ring 11 which fits in an annular groove 11' in upper part 1. In the middle, between O-ring 11, slot 10 is surrounded by a spring projection 23 of part 1 which fits a matching groove 24 in the lower part 2. In the bottom of the groove 24 of lower part 2, an annular groove 12' is likewise provided in which O-ring 12 fits to seal off jet sheet 14. In alignment with and below throughflow holes 9 for the liquid and slot 10', a slot 13 is likewise provided in lower part 2 whose upper area is very narrow. This upper area provides an opening only a little more larger than the width of the effective jet openings 14' of jet sheet 14.

Flush with lids 6, 7 and rear housing end wall 15, lower part 2 is sealed in a liquid-tight fashion by other lids 16 and 17 which are screwed in place. In lids 16, 17, at the level of jet sheet 14 held in the lower part, groove 18, 19 are, respectively, provided into which jet sheet 14 extends. In this position, the jet sheet can be easily gripped for replacement after removal of lid 16 or 17.

Figure 5:
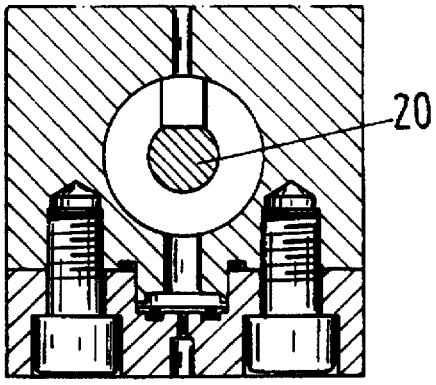
FIGS. 5–8 each show a section similar to that in FIG. 4 but with different impact body cross sections.
Figure 6:
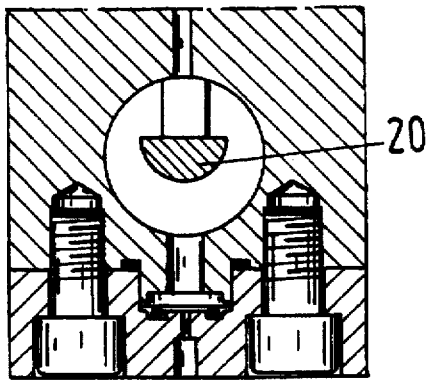
Figure 7:
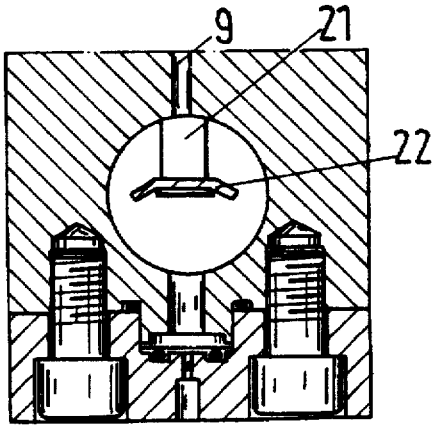
Figure 8:
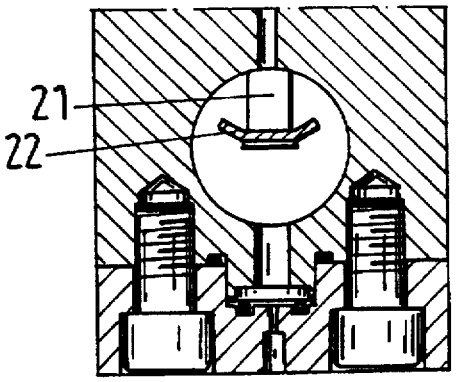
Figure 9:
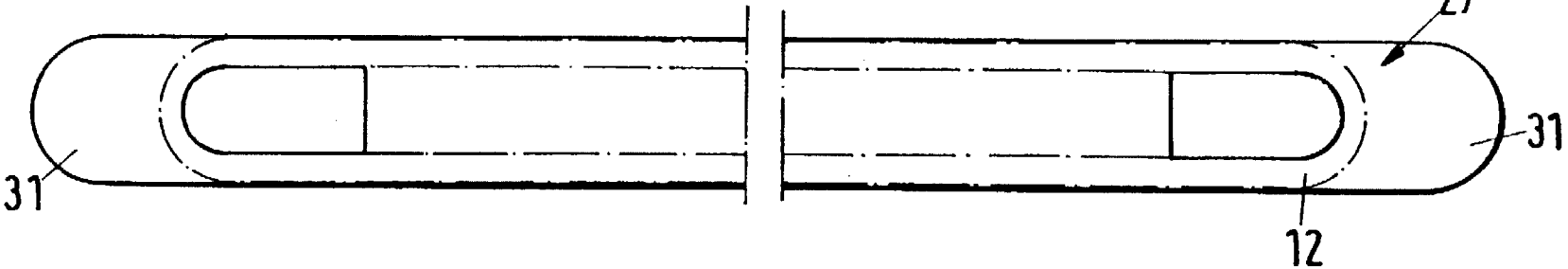
FIG. 9 is a bottom view of a repair lengthwise sheet with the O-ring tensioning device.

Pressure distribution chamber 5 in the embodiment is formed by a bore in the jet bar housing. Chamber 5 is, therefore, closed at the bottom. In order to allow the liquid to escape from pressure distribution chamber 5 toward jet sheet 14, slot 10 is provided, which is, therefore, smaller than the cross section of pressure distribution chamber 5. The liquid that enters through throughflow holes 9 is intended to distribute itself more uniformly in distribution chamber 5. This is accomplished by the volume of the pressure distribution chamber 5 and an impact body 20 mounted over the length of pressure distribution chamber 5 precisely between holes 9 and slot 10. Impact body 20 is mounted at a distance from intermediate partition 8 and allows the liquid to flow around on all sides. In order to permit this, the impact body is multiply-or multi-mounted on intermediate partition 8 by means of screws 21 over the length of the jet bar and at a distance from the partition. In this manner, the liquid emerging from through holes 9 initially strikes impact body 20, distributes itself in distribution chamber 5, and then flow with uniform pressure over the length of the bar through the fine holes in jet sheet Impact body 20 can have different cross sections. According to FIG. 4, it is circular and mounted precisely centrally in the bore of distribution chamber 5. The round bar can also have a straight impact surface at the top as shown in FIG. 5, and can even be halved or shaped as a hemisphere as desired as shown in FIG. 6. FIGS. 7 and 8, instead of a round rod, show a sheet 22 that is mounted perpendicularly to throughflow holes 9 by screws 21 in the pressure distribution chamber. The lengthwise edges around which the liquid flows can be bent against the flow direction (FIG. 8) or with the flow direction (FIG. 7).

Upper part 1, as described, has at its lower end the spring projection 23. The latter, with its outer edges 25, holds jet sheet 14 in contact with lower part 2. When subjected to pressure by liquid, it is forced by the pressure of the liquid against O-ring 12 and is thus sealed off from slot 13. It may then become necessary for O-ring 12 to be replaced, for example, if it is damaged when replacing jet sheet 14. In order to avoid disassembling lower part 2 from upper part 1 and thus having to loosen the many screws 3, in spring projection 23 on the surface opposite annular groove 12' for O-ring 12 a repair groove 26 is milled which is then delimited by edges 25. Repair groove 26 extends for the entire lengthwise and widthwise extent of the O-groove for O-ring 12 of lower part 2 and corresponds heightwise to a little more than the thickness of O-ring 12. A lengthwise sheet 27 of suitable dimensions can be inserted into this repair groove 26, said sheet having on an underside 28 facing the O-groove of the lower part, an O-ring tensioning device with dimensions that are the same or slightly larger than those of O-groove 12' of the lower part 2. The O-ring tensioning device includes two spacers 29 and 30 mounted on the underside of the lengthwise sheet 27 to provide an outer contour that corresponds to the dimensions of the O-groove 12' at its ends. For better retention of O-ring 12, the edges of spacers 29 and 30 are expanded conically downward, so that in cross section they provide converging surfaces. In addition, the distance between the spacers on the lengthwise sheet 27 may be made slightly larger than the O-ring so that the O-ring 12 that is held under tension is covered on the top and is, therefore, held firmly against lengthwise sheet 27. At each of the ends of the lengthwise sheet, an insertion end 31 that can be gripped with the hand is advantageously provided.

Figure 10:
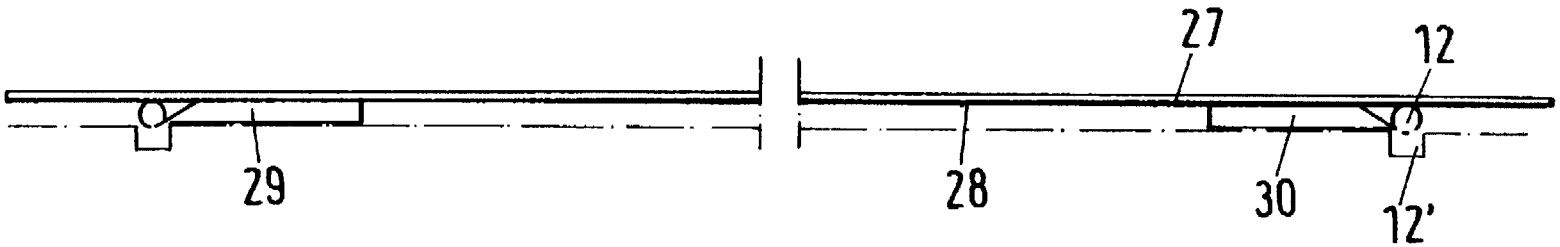
FIG. 10 shows a side view of the repair lengthwise sheet in the repair groove when inserting a replacement O-ring.

After lengthwise sheet 27 is placed in repair groove 26 as shown in FIG. 10, it is merely necessary by using a gauge or the like to roll replacement O-ring 12 downward from edges of spacers 29 and 30, so that O-ring 12 slips into groove 12'.

What is claimed is:

1. A jet bar on a device for producing streams of liquid for jet interweaving of the fibers of a fiber web guided along the bar, said bar comprising an upper part extending over the working width of the fiber web and a lower part fastened in a liquid-tight fashion thereto, a pressure chamber being provided in the upper part over its length, said pressure chamber receiving the liquid which is under pressure, land a pressure distribution chamber being circular in cross section and provided parallel to the pressure chamber with an intermediate partition located between the pressure chamber and the pressure distribution chamber, said pressure distribution chamber being connected with the pressure chamber by throughflow holes for the liquid located in the intermediate partition, and a jet sheet with holes for forming jets of liquid being mounted in a liquid-tight fashion on the lower part, wherein the pressure distribution chamber terminates in an area located opposite the throughflow holes for the liquid in a slot which is narrow by comparison with the cross section of the pressure distribution chamber, said slot terminating closely to the holes in the jet sheet.

2. A jet bar according to claim 1, wherein an impact body is located over the length of the slot in the pressure distribution chamber between the throughflow holes for the liquid and the slot.

3. A jet bar according to claim 2, wherein the impact body is located in the pressure distribution chamber in such fashions that the liquid flow can pass freely over its length and over its cross section.

4. A jet bar according to claim 3, wherein the impact body is located centrally in the pressure distribution chamber.

5. A jet bar according to claim 4, wherein the impact body is located at a midpoint of the pressure distribution chamber.

6. A jet bar according to claim 5, wherein the impact body is multiply mounted to and at a distance from the intermediate partition and over the length of the intermediate partition.

7. A jet bar according to claim 6, wherein screw connections are provided as spacers for multiply mounting the impact body to the intermediate partition.

8. A jet bar according to claim 7, wherein the impact body is made essentially circular in cross section.

9. A jet bar according to claim 8, wherein the impact body is provided on an influx side of the liquid with a flat impact surface.

10. A jet bar according to claim 7, wherein the impact body is made in the form of a sheet that extends perpendicularly to the arrangement of throughflow holes for the liquid.

11. A jet bar according to claim 10, wherein two lengthwise edges of sheet around which the flow takes place are bent against the flow direction.

12. A jet bar according to claim 10, wherein two lengthwise edges of sheet around which the flow takes place are bent in the flow direction.

13. A jet bar according to claim 1, wherein the jet sheet with the holes for forming the jets is mounted in a liquid-tight fashion by means of a sealing O-ring, and a repair groove is provided opposite to the jet sheet in the upper part of the jet bar, said repair groove extending over the entire length and width of an O-groove for the O-ring in the lower part, said repair groove having a depth corresponding to slightly more than the diameter of the O-ring.

14. A jet bar according to claim 13, wherein a lengthwise sheet is insertably mounted into the repair groove, said sheet providing an O-ring tensioning means on the underside facing the O-groove of the lower part, said tensioning means being dimensioned to be exactly the same as or slightly larger than the O-groove of the lower part.

15. A jet bar according to claim 14, wherein the O-ring tensioning means holds a replacement O-ring under tension which, following insertion of the lengthwise sheet into the repair groove, can be inserted into O-groove when a defective O-ring is removed.

16. A jet bar according to claim 14 or 15, wherein the O-ring tensioning means provided on the lengthwise sheet comprises a portion of the sheet corresponding to the dimensions of the O-groove in the lower part and two downwardly projecting spacers matching the roundness of the O-groove and mounted on the lengthwise sheet, said spacers being located at two ends of the O-groove at the ends of the jet bar.

17. A jet bar according to claim 16, wherein the lengthwise sheet providing the O-ring tensioning means extends beyond the width and length of the two spacers by at least a small amount.

* * * * *